United States Patent [19]

Vroomans et al.

[11] 3,995,001

[45] Nov. 30, 1976

[54] PROCESS FOR PREPARING POLYMER FIBERS

[75] Inventors: Hubertus J. Vroomans, Beek(L); Cornelis E.P.V. Van Den Berg, Geleen, both of Netherlands

[73] Assignee: Stamicarbon B.V., Geleen, Netherlands

[22] Filed: Jan. 21, 1974

[21] Appl. No.: 434,992

[30] Foreign Application Priority Data

Jan. 22, 1973 Netherlands ..... 7300864

[52] U.S. Cl. ..... 264/8; 162/157 R; 264/14; 264/121; 528/502

[51] Int. Cl.[2] ..... B22D 23/08

[58] Field of Search ..... 264/176, 8, 12; 260/94.9 F; 159/47 R; 34/10; 162/157 R; 528/502

[56] References Cited

UNITED STATES PATENTS

| | | | |
|---|---|---|---|
| 2,297,726 | 10/1942 | Stephanoff | 34/10 |
| 2,411,660 | 11/1946 | Manning | 264/DIG. 75 |
| 2,413,420 | 12/1946 | Stephanoff | 159/4 J |
| 2,433,000 | 12/1947 | Manning | 264/DIG. 75 |
| 2,437,263 | 3/1948 | Manning | 264/DIG. 75 |
| 2,508,462 | 5/1950 | Marshall | 264/12 |
| 2,571,457 | 10/1951 | Ladisch | 264/DIG. 75 |
| 3,026,190 | 3/1962 | McMahon et al. | 264/12 |
| 3,166,613 | 1/1965 | Wright et al. | 264/12 |
| 3,246,683 | 4/1966 | Yap et al. | 159/47 R |
| 3,309,734 | 3/1967 | Bynum et al. | 264/12 |
| 3,386,488 | 6/1968 | Ratzsch et al. | 264/5 |
| 3,544,078 | 12/1970 | Stupakis | 264/12 |
| 3,549,731 | 12/1970 | Kohn et al. | 264/8 |
| 3,549,732 | 12/1970 | Rice | 264/143 |
| 3,703,502 | 11/1972 | Venderbos et al. | 260/94.9 F |
| 3,719,648 | 3/1973 | Frielink et al. | 260/94.9 R |

*Primary Examiner*—Jay H. Woo
*Attorney, Agent, or Firm*—Cushman, Darby & Cushman

[57] ABSTRACT

Polymer fibers are made from a solution of polymer in solvent by subjecting the solution to shear forces in a confining space by introducing a gas stream into the space in a manner to create a rotary gas flow therein and to cool the solution to a temperature at which polymer precipitates from the solution in the form of fibers.

18 Claims, 1 Drawing Figure

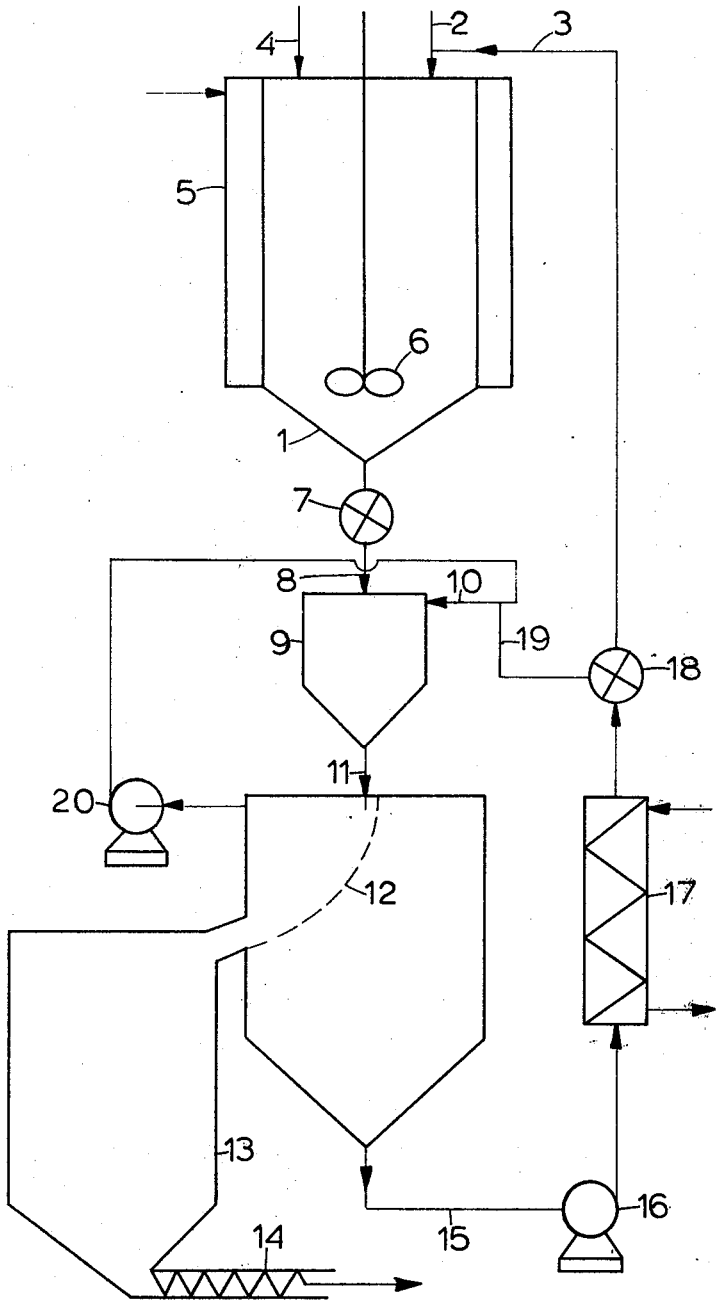
4
2
3
5
6
1
7
8
10
9
19
18
11
20
12
17
13
16
14
15

PROCESS FOR PREPARING POLYMER FIBERS

The invention relates to a process of preparing polymer fibres, in which a polymer solution is subjected to shear forces by bringing it into contact with a rotary gas flow to produce a fibrous polymer.

The fibres thus obtained can be used as a starting material for the manufacture of paper-like products, synthetic leather, textile products, such as nonwoven fabrics, and as a filling material for, e.g., plastic reinforced with fibres.

It is commonly known to prepare polyolefin fibres during the polymerization by subjecting the reaction mass to sufficiently large shear stresses. In these known processes a fibrous gel is formed in a reactor. Since the polymerization and the fibre formation take place in the same reaction vessel, it is difficult to so control the process conditions that both processes proceed most favorably. This method moreover has the drawback that a bulky, viscous mass is formed in the reactor, which unfavorably affects the reactor capacity and causes difficulties in discharging the polymer from the reactor. If use is made of stirrers, the fibres formed in the reactor will be wound round the stirrer, so that the polymerization must repeatedly be interrupted to remove these fibres.

It has previously been proposed to effect the formation of the fibres outside the reactor. In this process a polymer solution is stirred vigorously and cooled so that the polymer precipitates from the solution as fibres under the influence of shear forces. This known process also has the drawback that the production has to be interrupted very often to remove the fibres that have stuck to the stirrer.

It is also well known to prepare polymer fibres by making a gas flow rotate by means of a cyclone in which a feed pipe for the supply of liquid polymer has been fitted centrally (U.S. Pat. No. 2,571,457). After the rotating gas flow has left the cyclone, it strikes the jet of liquid polymer which is thus broken up into fibres. If polymer solutions are used, the solvent is fully evaporated. The polymer which contains only traces of solvent is then collected. As this process does not involve the precipitation of polymer by cooling of the solvent, it is necessary to evaporate the solvent completely. If evaporation is incomplete, any fibres that have formed will stick together and can hardly be processed further. Complete evaporation, however, requires that the solvent and the process conditions have to meet very stringent demands.

United States patent application Ser. No. 352,330 filed Apr. 18, 1973 suggests that these drawbacks can be overcome by mixing the polymer solution with a solvent that is identical to the solvent in which the polymer has been dissolved and which has such a temperature that the polymer in the mixture precipitates. In this method, the solvent and/or the polymer solution is fed to a radially symmetrical space so that a rotary flow is produced in the space. The mixture of solvent and precipitated polymer is then discharged from the radially symmetrical space and the precipitated polymer fibres are subsequently separated from the solvent. Although this process is a considerable improvement on the known methods, it still has various drawbacks. One drawback is that the yield of polymer fibres is largely dependent on the average molecular weight and the molecular-weight distribution of the polymer. This yield is also affected by other parameters, such as the feed rates and temperatures of the various flows. But even under optimum conditions the amount of undesired polymer powder formed is such that it cannot be disregarded. An additional drawback of this process is that it proves to be difficult to produce fibres of different geometry by varying the process conditions.

The general object of the present invention is to provide a process that does not have these drawbacks. A particular object is to provide a process which produces polymer fibres from a polymer solution in a simple and economical way and with a high yield. Another object is to provide a process in which the yield of fibres is less dependent on variations of the molecular-weight distribution and on other parameters. It is a further object to provide a process in which a higher throughput per unit volume of apparatus is obtained. A particular object is to provide a process in which the agitation of the polymer solution is not effected mechanically. Other advantages, such as influencing the geometry of the fibres formed, will be discussed hereinafter.

The process according to the invention for preparing polymer fibres, in which a polymer solution is subjected to shear forces by bringing it into contact with a rotary gas flow is characterized in that, during the contact of the polymer solution with the rotary gas flow, the polymer solution is exposed to shear forces and to such cooling that fibrous polymer precipitates in liquid solvent, after which the fibrous polymer is separated.

The applicants suspect, without being bound thereto, that it is important that the polymer solution is first subjected to shear forces by producing a rotary flow in this solution before it is cooled to below the precipitation temperature. In other words, the transfer of impulses to the polymer solution must be earlier or faster than the heat transfer. It is believed that the favorable results obtained by the process according to the invention are partly due to the fact that the two processes are correctly tuned to each other, if a gas is used for both the impulse and heat transfer.

The process according to the invention is preferably carried out in such a way that the rotary gas flow and the polymer solution are brought into contact in a radially symmetrical space, the gas flow being so fed to this space that the polymer solution in the space is subjected to shear forces and to cooling. The mixture of solvent, dispersed polymer fibres and gas is then discharged from the space and the polymer fibres are separated. It has been found that, in this way, not only an extremely good contact is obtained between the polymer solution and the gas flow, resulting in a high yield of polymer fibres, but also that the time of contact between the gas and the solution can be controlled in a simple way.

In the context of the present invention a radially symmetrical space denotes a space of radial symmetry which is provided with one or more feed tubes and one or more discharge tubes. These feed and discharge tubes may be placed, for instance, parallel to the axis of the space, but may also be fitted otherwise. By preference, at least one feed tube is mounted tangentially. The radially symmetrical space may have the shape of, e.g., a cone, a cylinder, a sphere, or combinations of part thereof.

The radially symmetrical space preferably consists of a cylinder that has been truncated rectangularly on both sides and into which the gas feed tube debouches, one truncated side of the cylinder being provided with a wall in which a feed tube may end, and the other truncated side of the cylinder containing the discharge opening.

By preference, the gas flow is fed tangentially to the radially symmetrical space, because it is thus possible to make the gas flow rotate without any other means, such as, e.g., guide blades. Naturally, part of the gas flow may be fed in at other places, provided the rotary flow is maintained.

Various locations may be chosen for the supply of the polymer solution. For instance, the solution may be fed in parallel to the direction of the axis of the radially symmetrical space. A choice can be made between a feed at the centre or at an eccentric location. It is also possible to feed the solution to the radially symmetrical body at other places or to the supply line for the gas flow.

In addition to the gas flow and the flow of polymer solution, other flows and/or substances, such as, e.g., a solvent, may be fed to the radially symmetrical space at one or several places. In this way variations in the geometry of the resulting fibres can be achieved.

The resulting suspension of polymer fibres in solvent and the gas may be discharged together from the radially symmetrical space.

It is also possible to bring the polymer solution and the gas flow into contact after the gas flow has left the radially symmetrical space and still rotates.

However, the formation of fibres is preferably effected inside the radially symmetrical space.

The polymers that can be used in the process of the invention should precipitate from the solvent used upon cooling. They must furthermore have a degree of polymerization of at least 2000 and, in addition, a linear structure with at most 15 side branches per 1000 carbon atoms. The polymers preferably have a melt index of below 10, in particular below 5, measured according to ASTM D 1238.

By preference, the polymers to be used are largely crystalline in the solid state.

Polyolefins, such as polyethylene, polypropylene, polybutene-1, and poly-4-methylpentene-1, are particularly suitable. Use may also be made of copolymers, preferably with at most 5 moles % of comonomer.

The solvent may be any of the solvents commonly used for the relative polymer. The solvent for the polyolefins may be, e.g., any of the following hydrocarbons: pentane, hexane, heptane, octane, cyclohexane, gasoline, pentamethyl heptane, benzene, toluene, xylene. use may also be made of mixtures and of halogenated hydrocarbons, such as dichloroethene and trichloroethylene.

The process is particularly suitable for use with polymers prepared by processes in which a polymer solution is formed directly at so high a catalyst activity that the catalyst residue need not be removed and the polymer solution need not be subjected to an expensive washing process before it can be turned into polymer fibres.

The gases to be used according to the invention also include vapors. These gases may be both inert and chemically active with respect to the polymer used. Examples of gases or vapors are saturated hydrocarbons, such as methane, ethane, propane, butane, pentane, hexane, heptane, unsaturated hydrocarbons, such as ethene, propene, butene, pentene, hexene, and heptene, and furthermore nitrogen, carbon-dioxide gas, oxygen, ammonia, steam, helium and hydrogen. Use may also be made of mixtures of gases, such as air, gases contaiing oxidizing agents, or mixtures of alkanes and/or alkenes.

The flow rate and the temperature of the gas flow to be used are so chosen that, after the gas flow has been brought into contact with the polymer solution, the final temperature of the mixture is below the precipitation temperature of the polymer, that is the temperature at which polymer precipitates from the solution as the solution is cooled. By preference, this final temperature is at most 150° C, in particular at most 75° C, below the precipitation temperature of the polymer. The precipitation temperature of the polymer depends in part on the structure, the molecular weight and the concentration of the polymer and the nature of the flow. In a stirred solution, polyethylene precipitates at about 107° C, polypropene at about 115° C and polybutene-1 at about 52° C. In a stationary solution, precipitation takes place at a lower temperature, e.g., 96° C in the case of polyethylene.

Cooling of the polymer solution is effected by means of the gas flow. This flow should therefore be cooler than the polymer solution. Further cooling can be effected, if use is made of a radially symmetrical space, by cooling the space externally or by injection into this space of colder substances of flows.

Use is preferably made of polymer solutions with a temperature not exceeding the precipitation temperature by more than 150° C, in particular by more than 100° C.

The temperature of the gas flow is preferably no more than 250° C, in particular no more than 150° C, lower than the precipitation temperature.

The decrease in temperature of the polymer solution which is caused by the gas flow may be accompanied by an additional drop in temperature as a result of the evaporation of the solvent. This evaporation is preferably restricted to less than 50% of the solvent. In any case, the amount of evaporated solvent does not exceed 75%.

The polymer fibres formed by the process according to the invention are separated from the solvent by means of the usual apparatus, e.g., sieves and centrifuges. It is highly profitable, however, to use a sieve bend, as it has been found that it is pre-eminently suitable to separate the resulting fibres from the mixture obtained. The solvent separated off can again be used for the preparation of the polymer solution, e.g., by effecting a polymerization in this solvent.

The admissible polymer concentrations in the polymer solutions to be used are generally not higher than about 50% by weight, in particular 30% by weight, because of the high viscosity and the attendant difficult processability. Concentrations of below 0.1% by weight may be used in principle, but are usually unattractive for reasons of economy. Use is preferably made of solutions with concentrations ranging between 1 and 20% by weight.

The ratio between the flow rates of the flow of polymer solution and the gas flow may be varied within wide limits. Use is preferably made of more than 2 kg, in particular more than 5 kg, of gas per 100 kg of polymer solution. Although the upper limit of the ratio of the amount of gas to the amount of polymer solution is not critical and may be chosen freely, no more than 1000 kg, preferably no more than 500 kg, of gas per kg of polymer solution will be used for reasons of economy. This ratio may be varied in order to produce polymer fibres of different geometry. Thus it is possible to obtain finer fibres by using more gas relative to the amount of polymer solution.

The velocity of the gas flow when entering the radially symmetrical space may be both subsonic and supersonic. In most cases, however, subsonic rates suffice to produce the desired fibres.

By preference, the rates of the gas flow and the dimensions of the radially symmetrical space are so chosen that the Reynold's number ranges between $10^3$ and $10^9$, in particular between $10^4$ and $10^7$. "Reynold's number" as used here denotes the product of the linear velocity of the gas flow when entering the radially symmetrical space and the inner diameter of this space, divided by the kinematic viscosity of the gas flow.

If the solution is fed directly to the radially symmetrical space, the retention time of the solution in this space will depend on the flow rate of the solution and the dimensions of the radially symmetrical space. This retention time may vary widely, e.g., from $10^{-4}$ second to dozens of seconds, preferably from $10^{-3}$ to 10 seconds.

If it is required for the fibres to contain certain substances for a specific use, these substances may be added to the solution, so that the fibres prepared from this solution consist of a homogeneous mixture of these substances and the polymer. For instance, the addition of titanium dioxide to the solution will produce white fibres and improve the printability of sheets prepared from these fibres. Furthermore, mixtures of polymers may be dissolved in the solvent or a mixture of polymer solutions may be used to prepare fibres with specific properties. Thus, the coherence of the fibres in a sheet prepared from the fibres can, for instance, be improved by adding a rubber solution to the polymer solution.

The process according to the invention may be carried out at widely varying pressures, at both atmospheric and subatmospheric or superatmospheric pressures. In practice, use will be made of pressures of between 0.01 and 5000 atm, in particular between 1 and 100 atm.

The fibres obtained by the process according to the invention have a diameter varying from parts of a micron to some hundreds of microns. The length of the fibres may be quite large, e.g., up to some centimeters, while the fibres may have branches.

It is often important to beat the fibres obtained. To this end use may be made of the equipment commonly employed in paper manufacture, such as, e.g. disc refiners or Hollander beaters. Thus it is possible to make these fibres excellently suitable for the manufacture of paper-like products. If so desired, the fibres may be mixed with normal paper pulp and be processed on the machines commonly used in paper manufacture.

The invention will be further elucidated with reference to the drawing and examples of the embodiment.

The sole FIGURE is a schematic illustration of a plant for preparing polymer fibres from a polymer solution.

Pentamethyl heptane is fed to vessel 1 through conduits 2 and 3, and high-density polyethylene through conduit 4. The vessel is provided with a heating jacket 5, through which steam is passed which has such a temperature that the contents of the vessel are maintained at a temperature of 140° C. The polyethylene is mixed in the liquid by means of a stirrer 6 and goes into solution. The amount of polyethylene and solvent have been so chosen that the solution contains 10% by weight of polyethylene.

The solution flows centrally into a rotation chamber 9 through a control valve 7 and a discharge conduit 8. Through conduit 10, nitrogen is fed tangentially to chamber 9 at such a pressure that a rotary flow is produced there. The temperature of the nitrogen has been so chosen that, after the nitrogen has been mixed with the hot solution, the temperature is 50° C below the precipitation temperature of the polyethylene, which is 103° – 107° C under the conditions prevailing in the rotation chamber.

Large shear forces are produced in the rotation chamber, so that the polyethylene precipitates in the form of fibres. The mixture of polyethylene fibres, solvent and nitrogen is passed through a central opening in the lower, pointed end of the rotation chamber and through a conduit 11 and flows onto a sieve bend 12.

The recovered fibrous polyethylene is discharged by way of collecting vessel 13 and screw conveyor 14.

The solvent separated off flows through conduit 15 to a pump 16, which passes the solvent through a heat exchanger 17 and a distributing valve 18, part being fed to vessel 1 through conduit 3 and part being fed through conduit 19 to the nitrogen supply line 10, where it is dispersed in the nitrogen flow, after which the resulting dispersion can be fed to the rotation chamber 9. The amount of solvent leaving the recycle system at 14 together with the discharged fibres is compensated by additional solvent entering through the conduit 2. The nitrogen flowing from conduit 11 is returned to rotation chamber 9 through conduit 10 by means of a pump 20.

EXAMPLE I

Experiments were carried out in which a cylindrical cyclone with a diameter of 1 cm and a length of 8 cm was fed tangentially with 1.5 $m^3$ of nitrogen of 20° C per hour at the velocity at 135 meters per second. The Reynold's number was $1 \times 10^5$. A solution of high-density polyethylene (density 0.95 to 0.96 and 1 to 6 side branches per 1000 carbon atoms) in pentamethyl heptane with a temperature of 140° C was fed centrally to the cyclone. Polymer fibres were formed under the influence of the shear forces and cooling produced in the cyclone by the gas flow. The temperature of the resulting dispersion was 50° – 65° C. Other process conditions and the results of the experiments are compiled in Table I.

Table I

| melt index of polymer* | concentration of solution | flow rate of solution | temperature of dispersion | % fibres | diameter of fibres |
|---|---|---|---|---|---|
| 0.46 | 25 g/l | 2 l/h | 65° C | 100 | 10–100 μm |
| 0.13 | 50 | 1.1 | 50 | 100 | 10–60 |
| 0.13 | 50 | 2 | 65 | 100 | 5–30 |
| 0.13 | 25 | 2 | 65 | 100 | 5–20 |

Table I-continued

| melt index of polymer* | concentration of solution | flow rate of solution | temperature of dispersion | % fibres | diameter of fibres |
|---|---|---|---|---|---|
| 0.13 | 10 | 2 | 60 | 100 | 5–30 |

*Measured according to ASTM D 1238 A; this also applies to all other examples, unless specifically stated otherwise.

EXAMPLE II

Example I was repeated while 1 liter of pentamethyl heptane of 20° C was fed to the gas flow per hour. The results are compiled in Table II.

Table II

| melt index of polymer | concentration of solution | flow rate of solution | temperature of dispersion | % fibres | diameter of fibres |
|---|---|---|---|---|---|
| 0.5 | 50 g/l | 1.2 l/h | 55° C | 100 | 5–15 μm |
| 0.006 | 35 | 1.3 | 55 | 100 | 3–10 |
| 0.13 | 50 | 1.1 | 50 | 100 | 5–30 |

EXAMPLE III

Example I was repeated while the throughput and the velocity of the gas were varied. Moreover, pentamethyl heptane (pmh) was added to the gas flow. The concentration of the solution was 50 g per liter. The temperature of the resulting dispersion was 50° C. The results are compiled in Table III.

Table III

| velocity of gas | flow rate of gas | Reynold's number | addition of pmh | melt index of polymer | flow rate of solution | % fibres | diameter of fibres |
|---|---|---|---|---|---|---|---|
| 115 m/s | 1.3 $m^3$/h | $0.8 \times 10^5$ | 4 l/h | 0.13 | 1.1 l/h | 100 | 5–20 μm |
| 110 | 1.2 | $0.75 \times 10^5$ | 6 | 0.13 | 1.1 | 100 | 2–20 |
| 110 | 1.2 | $0.75 \times 10^5$ | 6 | 7.6 | 1.2 | 60 | 5–30 |

EXAMPLE IV

Example I was repeated with a solution of polypropylene (melt index 0.6, measured according to ASTM D 1238 L) and with a solution of a mixture of polypropylene (melt index 0.6) and high density polyethylene (melt index 0.13) in pentamethyl heptane. With a velocity of 110 m/s, nitrogen gas of 20° C to which 6 liters/h of pentamethyl heptane was added, was fed in an amount of 1.2 $m^3$ per hour. The Reynold's number was $0.75 \times 10^5$. 1.1 liters/h of the polymer solution with a concentration of 50 g of polymer per liter of solvent were fed centrally to the cyclone. Fibres with diameters of 10 to 100 μm were produced from the polypropylene solution, the yield being 95%. The remaining 5% of the polymer were separated off as a powder. The solution of the mixture of polypropylene and polyethylene produced fibres of 20 – 100 μm in diameter, the yield being 100%. The temperature of the resulting dispersion was 50° C in both cases.

EXAMPLE V

Experiments were carried out with various cyclones. Polymer solutions of high-density polyethylene (melt index 0.13) in pentamethyl heptane (40 g/l) were fed centrally to the various cyclones at a temperature of 140° C. A nitrogen flow was fed tangentially to the cyclones. The resulting fibres were separated from the solvent by means of a sieve bend. The results of these experiments are compiled in Table IV.

Table IV

| dimensions of cyclone diameter × length* | velocity of gas feed | Reynold's number | temp. of gas | flow rate of solution | temp. of dispersion | fibres % | diameter of fibres |
|---|---|---|---|---|---|---|---|
| 6.5 × 8 cm | 70 m/s | $3.3 \times 10^5$ | 20° C | 60 l/h | 60° C | 99 | 20–100 μm |
| 6.5 × 8 | 145 | 6.7 | 20 | 100 | 75 | 100 | 10–60 |
| 3 × 3 | 115 | 3.2 | 20 | 50 | 60 | 100 | 10–100 |
| 6.5 × 8 | 140 | 6.6 | 20 | 60 | 70 | 98 | 20–80 |
| 6.5 × 8 | 70 | 3.3 | 20 | 60 | 75 | 97 | 20–100 |
| 3 × 3 | 115 | 2.5 | −18 | 50 | 35 | 95 | 5–50 |
| 3 × 3 | 115 | 2.5 | 20 | 70 | 65 | 98 | 10–100 |
| 3 × 3 | 115 | 2.5 | 80 | 50 | 60 | > 95 | 30–80 |

*The diameter of the gas feed opening was 10 mm.

EXAMPLE VI

Example V was repeated while steam of 100° C was used as gas. This steam was fed tangentially to a cyclone with a diameter of 3 cm and a length of 10 cm. The feed velocity was 140 m/s, the Reynold's number $0.7 \times 10^5$. The solution was fed in at the rate of 30 l/h. The temperature of the resulting dispersion was 100° C.

The fibres obtained had diameters of 5 to 60 μm. The yield was 95%.

EXAMPLE VII

A nitrogen flow was fed tangentially to a tapering cyclone with a largest diameter of 40 mm and a length of 55 mm. A flow of solution was passed centrally through the cyclone and through the gas discharge opening via a tube ending just outside the gas discharge opening.

Consequently, the rotary gas flow leaving the cyclone struck the flow of solution outside the cyclone.

30 $m^3$/h of nitrogengas of 20° C were fed in at the velocity of 105 meters per second (Reynold's number $3.0 \times 10^5$), while a solution of 40 g/l of high-density polyethylene (melt index 0.13) in pentamethyl heptane was put through at the rate of 20 to 120 liters per hour. The polymer fibres which formed outside the cyclone and the solvent were collected and the fibres were separated from the solvent.

The yield was 100%. The temperature of the dispersion was 40°– 80° C, depending upon the amount of solution put through. The amount of pentamethyl heptane that had evaporated was less than 10% in all cases. The fibres obtained had diameters of 3 to 50 μm.

EXAMPLE VIII (Comparative example)

Example I was repeated with a solution of 50 grams of low-density polyethylene (melt index 0.3, 18 side branches per 1000 carbon atoms and density 0.929) per liter of pentamethyl heptane.

6 liters of pentamethyl heptane were fed to the gas flow per hour. No fibres were formed, all of the precipitated polymer was a fine powder.

EXAMPLE IX (Comparative example)

The cyclone of Example VII was used to prepare fibres from a solution of high-density polyethylene in heptane. A nitrogen flow of 40 $m^3$ per hour was tangentially fed to the cyclone at the velocity of 140 meters per second. The temperature of the nitrogen flow was 20° C. The polyethylene solution (25 grams per liter) was put through at the rate of 70 liters per hour and at a temperature of 140° C. The Reynold's number was $3.9 \times 10^5$.

During the formation of the polymer fibres, which was effected outside the cyclone, the entire amount of the low boiling solvent evaporated.

The temperature of the resulting mixture of gas, vapor and polymer fibres was 34° C.

The amount of polymer fibres formed was less than 20% calculated to the total amount of polyethylene.

EXAMPLE X

A similar flow of gas as used in Example IX was fed to a cyclone with a diameter of 3 cm and a length of 3 cm. This cyclone was fed centrally with a solution of 30 grams of high-density polyethylene per liter of heptane at a temperature of 140° C and a feed rate of 70 liters per hour. The Reynold's number was $3 \times 10^5$. The fibres formed in the cyclone, while only 40% of the solvent evaporated. The temperature of the suspension of fibres in solvent was 36° C. The yield of fibres was 100%, and the fibres produced had diameters of 50 to 200 μm.

EXAMPLE XI

A cyclone having a diameter of 2.5 cm and a length of 4 cm was fed tangentially with 6 $m^3$ of nitrogen per hour at a temperature of 20° C. The velocity of the nitrogen flow when entering the cyclone was 140 meters per second. 6 liters/hour of pentamethyl heptane were fed to this nitrogen flow before it entered the cyclone. The Reynold's number was $2.5 \times 10^5$.

A varying amount of a solution of 50 grams of high-density polyethylene per liter of pentamethyl heptane was fed centrally to this cyclone at 140° C. The temperature of the resulting dispersion of polymer fibres in pentamethyl heptane was 40° C.

The results of this experiment are compiled in Table V.

Table V

| throughput of solution liters per hour | melt index of polymer | yield of fibres | diameter of fibres |
|---|---|---|---|
| 1.5 | 0.13 | 100% | 5–20 μm |
| 4.5 | 0.13 | 100 | 10–20 |
| 1.5 | 0.03 | 100 | 5–20 |
| 4.5 | 0.03 | 100 | 10–30 |

EXAMPLE XII

Example X was repeated with a solution of coplymer of ethylene and 6% by weight of butylene (melt index 4.5; density 0.937). The solution was put through at the rate of 1.5 liters per hour.

The yield of fibres was 98%, and the fibres had diameters of 0.5 to 10 μm.

What is claimed is:

1. Process for preparing polymer fibres comrising subjecting a solution of a substantially linear polymer having at most 15 side branches per 1000 carbon atoms in solvent to shear forces by bringing it into contact with a rotary gas flow and cooling the polymer solution during the contact of the polymer solution with the rotary gas flow to precipitate polymer fibres in the liquid solvent, and thereafter separating the polymer fibres from the solvent.

2. A process as in claim 1 wherein the rotary gas flow and the polymer solution are brought into contact in a radially symmetrical space, the gas flow being so fed to this space that the polymer solution is subjected to shear forces and to cooling, and thereafter discharging the mixture of solvent, dispersed polymer fibres and gas from the space.

3. A process as in claim 2 wherein at least part of the gas flow is fed tangentially to the radially symmetrical space.

4. A process as in claim 2 wherein the temperature of the gas flow before it contacts the polymer solution is lower than the temperature of the polymer solution.

5. A process as in claim 1 wherein the temperature of the polymer solution before it contacts the gas flow is at most 150° C above the precipitation temperature of the solution.

6. A process as in claim 5 wherein the temperature of the polymer solution is at most 100° C above the precipitation temperature of the solution.

7. A process as in claim 1 wherein the temperature of the gas flow is no more than 250° C below the precipitation temperature of the solution.

8. A process as in claim 1 wherein the temperature of the gas flow is no more than 150° C below the precipitation temperature of the solution.

9. A process as in claim 1 including feeding additional solvent to the gas flow before the latter contacts the polymer solution.

10. A process as in claim 2 wherein the mixture discharged from the radially symmetrical space is passed to a sieve bend to separate the polymer fibres.

11. A process as in claim 1 wherein the polymer has a melt index smaller than 10.

12. A process as in claim 1 wherein the polymer is an $\alpha$-olefin with 2 to 6 carbon atoms.

13. A process as in claim 1 wherein the polymer solution contains at most 30% by weight of polymer.

14. A process as in claim 13 wherein the polymer solution contains 1 to 20% by weight polymer.

15. A process as in claim 1 wherein the weight ratio between the amounts of gas and polymer solution is between 1:50 and 1000:1.

16. A process as in claim 15 wherein said ratio is beween 1:20 and 500:1.

17. A process as in claim 2 wherein the average retention time in the radially symmetrical space of both the gas and the polymer solution is less than 10 seconds.

18. A process as in claim 1 including beating the fibres after they have been separated from the solvent.

* * * * *